US009457980B2

(12) United States Patent
Kuypers et al.

(10) Patent No.: US 9,457,980 B2
(45) Date of Patent: Oct. 4, 2016

(54) SHEET STACKING DEVICE

(71) Applicant: OCE-TECHNOLOGIES B.V., Venlo (NL)

(72) Inventors: Herman Kuypers, Velden (NL); Stan H. L. A. Rutten, Eindhoven (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 12 days.

(21) Appl. No.: 14/274,138

(22) Filed: May 9, 2014

(65) Prior Publication Data

US 2014/0246827 A1 Sep. 4, 2014

Related U.S. Application Data

(63) Continuation of application No. PCT/EP2012/071899, filed on Nov. 6, 2012.

(30) Foreign Application Priority Data

Nov. 9, 2011 (EP) ..... 11188411

(51) Int. Cl.
*B65H 29/20* (2006.01)
*B65H 29/40* (2006.01)
(Continued)

(52) U.S. Cl.
CPC ..... *B65H 29/40* (2013.01); *B65H 29/22* (2013.01); *B65H 31/36* (2013.01); *B65H 43/00* (2013.01);
(Continued)

(58) Field of Classification Search
CPC ..... B65H 29/40; B65H 2301/44765; B65H 15/02; B65H 29/00; B65H 29/20; B65H 29/22; B65H 31/00; B65H 31/36; B65H 2301/4212; B65H 2403/51; B65H 2404/265; B65H 2404/652; B65H 43/00
USPC ..... 271/207, 220, 184–187, 314, 315
See application file for complete search history.

(56) References Cited

U.S. PATENT DOCUMENTS 5,065,997 A 11/1991 Butts et al.
5,098,080 A * 3/1992 Arnone ..... B65H 29/40 271/187

(Continued)

FOREIGN PATENT DOCUMENTS

EP 0 867 394 A1 9/1998
EP 1 233 310 A2 8/2002

(Continued)

OTHER PUBLICATIONS

Form PCT/ISA/237 Written Opinion of the International Searching Authority.

*Primary Examiner* — Prasad Gokhale
(74) *Attorney, Agent, or Firm* — Birch, Stewart, Kolasch & Birch, LLP

(57) ABSTRACT

A sheet stacking device for forming a stack of subsequent sheets includes a rotatably arranged flipping element and a closed-loop shaped friction element. The flipping element includes a slot at its circumferential edge for accepting at least a portion of a sheet. In a first rotation zone, the flipping element is able to accept the sheet into the slot and, in a second rotation zone, the sheet is conveyed out of the slot onto the top of the stack of subsequent sheets. The friction element is moveably arranged on the flipping element, and is controllable to move into a first radial position and a second radial position. In the first radial position, the friction element does not apply a frictional force to a sheet in the transport path and in the second radial position, the friction element does apply a frictional force to a sheet in the transport path.

15 Claims, 4 Drawing Sheets

(51) Int. Cl.
*B65H 31/36* (2006.01)
*B65H 29/22* (2006.01)
*B65H 43/00* (2006.01)

(52) U.S. Cl.
CPC ..... *B65H 2301/4212* (2013.01); *B65H 2301/44765* (2013.01); *B65H 2403/51* (2013.01); *B65H 2404/265* (2013.01); *B65H 2404/652* (2013.01)

(56) References Cited

U.S. PATENT DOCUMENTS 5,476,256 A * 12/1995 Fortuna ..... B65H 29/40 101/415.1
5,685,532 A * 11/1997 Amarakoon ..... B26F 1/08 270/58.07
5,803,705 A 9/1998 Keyes
6,019,209 A * 2/2000 Hara ..... B65H 29/40 194/206
6,302,393 B1 * 10/2001 Beskitt ..... B65H 29/06 271/187
6,331,000 B1 12/2001 Beskitt et al.
6,619,653 B2 * 9/2003 Dobrindt ..... B65H 29/40 271/187
7,017,900 B2 * 3/2006 Dobrindt ..... B65H 29/06 198/441
7,837,189 B2 * 11/2010 Young ..... B65H 29/40 271/187
8,235,382 B2 * 8/2012 Taniguchi ..... B65H 29/06 271/187
2004/0251622 A1 * 12/2004 Dobrindt ..... B65H 29/06 271/315
2004/0256798 A1 * 12/2004 Dobrindt ..... B65H 29/06 271/315
2006/0104660 A1 5/2006 Doi et al.
2007/0056453 A1 * 3/2007 Dinnissen ..... B65H 29/40 101/232
2010/0032895 A1 * 2/2010 Sahara ..... B65H 29/14 271/314
2010/0303508 A1 12/2010 Tamura

FOREIGN PATENT DOCUMENTS

EP 1 762 523 A2 3/2007
FR 2 760 733 A1 9/1998
JP 01-094345 U 6/1989
JP 02-040754 U 3/1990
JP 5-338890 A 12/1993
JP 06-061857 U 9/1994
JP 2007-63020 A 3/2007

* cited by examiner

SHEET STACKING DEVICE

CROSS-REFERENCE TO RELATED APPLICATIONS

This application is a Continuation of International Application No. PCT/EP2012/071899, filed on Nov. 6, 2012, and for which priority is claimed under 35 U.S.C. §120. PCT/EP2012/071899 claims priority under 35 U.S.C. §119(a) to Application No. 11188411.0, filed in Europe on Nov. 9, 2011. The entire contents of each of the above-identified applications are hereby incorporated by reference into the present application.

BACKGROUND OF THE INVENTION

1. Field of the Invention

The present invention is related to a sheet stacking device for forming a stack of subsequent sheets and to a printing system comprising such a sheet stacking device.

2. Description of Background Art

A typical example of such a sheet stacking device is known from U.S. Pat. No. 5,065,997. This known device comprises a pair of disks, which have been mounted onto a driven rotation shaft. Each one of the disks comprises a pair of acceptance slots, as well as a pair of friction elements. During the course of a cycle, incoming sheets may be accepted into the slots that have been made in the disk. If applicable, the incoming sheets have already sustained an initial lateral registration course and are conveyed into a slot by means of an input clamping arrangement. An accepted sheet is conveyed onto a receiving plane during part of the revolution, after which the friction elements will convey the sheet against a stop during part of the revolution.

A disadvantage of this known device is that, in use, it is not sufficiently precise in producing accurately formed stacks. In use, it regularly happens that sheets stacked by the known device fail to end up in an orderly manner on the stack formed on the receiving plane. Deviations in the orientation of sheets relative to one another and relative to the reference planes are highly undesirable, particularly if the stacks are to be further post-processed, such as in binding applications.

SUMMARY OF THE INVENTION

An object of the present invention is to provide a stacking device for incoming sheets, where the sheets are accurately stacked in a reliable manner. To this end, a device has been invented according to the present invention, wherein in operation a sheet follows a transport path from a sheet supply to a receiving plane on which the stack of subsequent sheets is formed. The sheet stacking device comprises a rotatably arranged flipping element and closed-loop shaped friction element. The rotatably arranged flipping element includes a slot at a circumferential edge thereof for accepting at least a portion of a sheet to be stacked. The rotatably arranged flipping element is configured such that, in a first rotation zone, the rotatably arranged flipping element is able to accept the sheet from the sheet supply into the slot and, in a second rotation zone, the sheet is conveyed out of the slot onto the top of the stack of subsequent sheets on the receiving plane. The closed-loop shaped friction element is moveably arranged on the rotatably arranged flipping element, such that the closed-loop shaped friction element is controllable to move into one of a first radial position and a second radial position. In the first radial position, the closed-loop shaped friction element does not apply a frictional force to a sheet in the transport path, and in the second radial position, the closed-loop shaped friction element does apply a frictional force to a sheet in the transport path.

In the device according to the present invention, the registration of incoming sheets already performed is retained more effectively and there is no additional obstruction to the incoming movement of sheets. Due to the positioning of the friction elements according to the present invention, a significant improvement of the alignment of the stacks formed on the receiving plane is achieved. Any further binding processes may therefore form more accurate documents and the user will experience, also in cases where no further post-processing is performed, a higher quality of stacks and documents delivered. It shall be clear for the skilled person that the closed-loop shaped friction element does not necessarily consist of a closed-loop element. The function of the element is based upon the function of the friction element, such as the curved friction element as described and depicted herein. It is not necessary that the loop is closed.

In an embodiment of the present invention, the closed-loop shaped friction element is controlled to move into the first radial position, if the closed-loop shaped friction element is in the first rotation zone. In the first rotation zone as described here above, a sheet may be fed into the slot on the rotatably arranged flipping element. Therefore, the device in accordance with the present invention moves the closed-loop shaped friction element into its first radial position, in which the closed-loop shaped friction element does not apply a frictional force to a sheet in the transport path. In this retracted position, the closed-loop shaped friction element does not disturb an incoming sheet during its reception into the slot. As a result of the non-disturbance of the sheet by the closed-loop shaped element, the sheet retains its lateral alignment during its transport over the transport path from the sheet supply via the rotatably arranged flipping element to the stack formed on the receiving plane, or if a stack is already formed, onto the top of the stack of sheets.

In an embodiment of the present invention, the closed-loop shaped friction element is controlled to move into the second radial position if the closed-loop shaped friction element is in the second rotation zone. In the second rotation zone as described hereabove, a sheet is expelled from the slot onto the receiving plane, or if a stack has already been formed, onto the top of the stack. Therefore, the device in accordance with the present invention moves the closed-loop shaped friction element into its second radial position, in which the closed-loop shaped friction element does apply a frictional force to a sheet in the transport path. In this extended radial position, the closed-loop shaped friction element is able to apply some friction on the top of the top sheet of the stack to gently urge this sheet to align against a stopping member, which limits the motion of the sheet in the transport direction, thereby defining an alignment edge of the stack. In its second radial position the closed-loop shaped element may extend partially beyond a radius of the flipping element or may be moved completely beyond the local edge of the flipping element.

In an embodiment of the present invention, the control of the movement of the closed-loop shaped friction element comprises a cam and cam follower construction. By means of a cam and cam follower combination, a simple and reliable construction assures that the movement of the closed-loop shaped element is synchronized with its position, such that the effects as described here above are rendered every revolution of the rotatably arranged flipping element.

In a further embodiment of the present invention, the sheet stacking device further comprises a cam element, which is rotatably arranged on the rotatably arranged flipping element, wherein the closed-loop shaped friction element is mounted on the cam element. By mounting the closed-loop shaped element on a cam element, which is rotatably mounted on the flipping element, the application of a cam and cam follower combination enables a smooth variation between the first radial position of the closed-loop shaped element and the second radial position of the closed-loop shaped element.

In a further embodiment of the present invention, the cam element is urged into the first radial position by means of a biasing element, such as a spring. This biasing force defines a passive home position of the closed-loop shaped element during a rotation of the flipping element. The cam, which may be arranged such that in the first rotation zone the biasing force is overcome and the closed-loop shaped element is forced towards its second radial position. It may be advantageous to configure the biasing force such that the effects of the forces imposed on the closed-loop shaped element and/or the cam element on which the closed-loop shaped element is mounted as a result of the rotation of the flipping element are suppressed.

In an embodiment of the present invention, the movement of the closed-loop shaped element is actuated by means of an electric motion actuator, such as a linear drive motor or the like, and such that its motion is electronically controlled. Known servo-control mechanisms may be applied to implement this motion. Sensors may be implemented to synchronize the movement with the applicable rotation zones and/or radial positions of the closed-loop shaped element.

In another aspect of the present invention, a printing device is disclosed, comprising a sheet supply unit, a printing engine for applying a marking substance to a sheet and the sheet stacking device according to the present invention. As printing systems reach increasingly higher printing speeds, it is very advantageous that stacking units as part of such printing systems can cope with these higher speeds while maintaining or even increasing the quality of alignment of these stacks. The printing system according to the present invention fulfils this requirement with the features disclosed herein.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
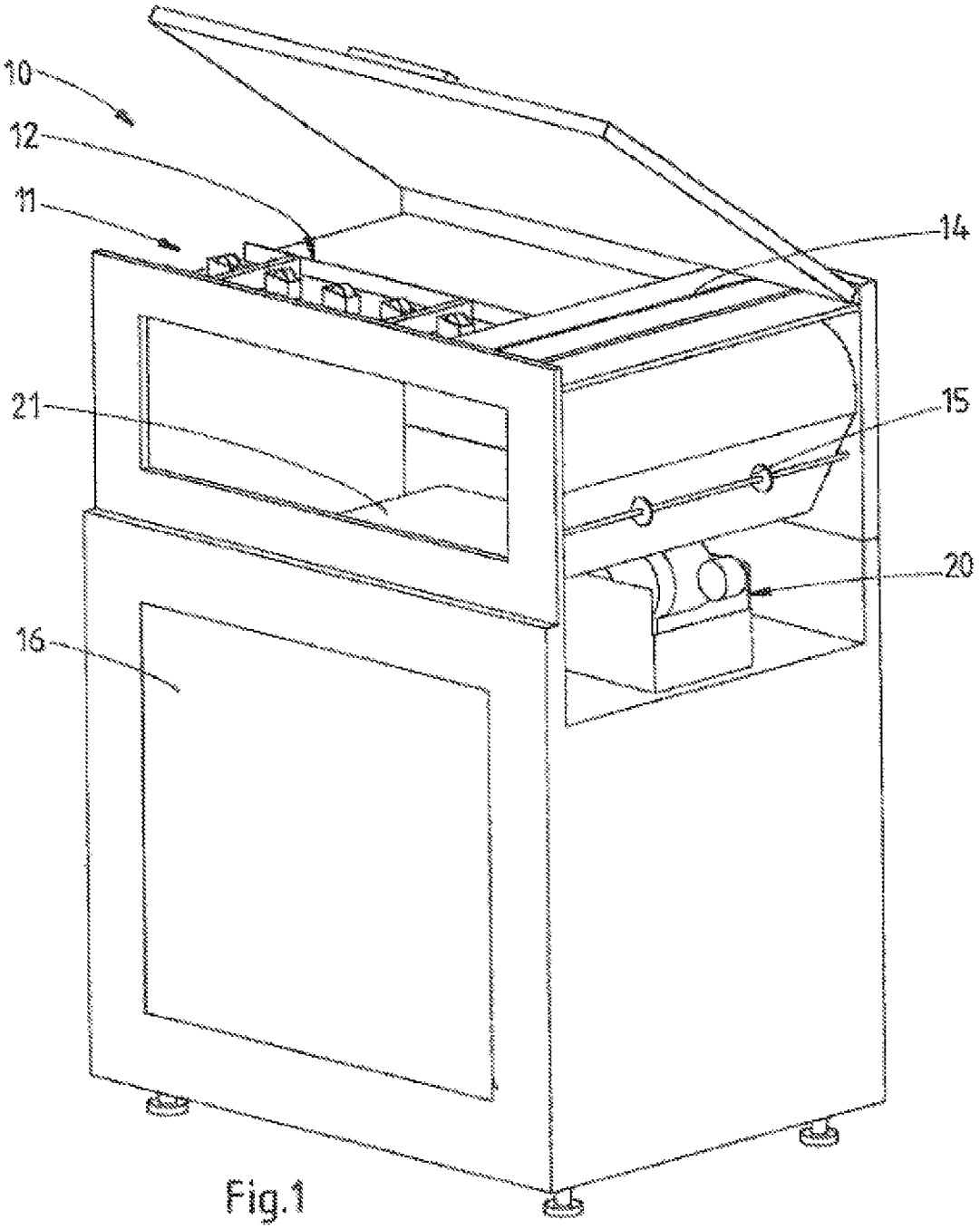
FIG. 1 is a schematic perspective view showing a stacking device 10 according to the present invention.

The present invention will now be described with reference to the accompanying drawings, wherein the same or similar elements are identified with the same reference numerals throughout the several views.

FIG. 1 is a diagram showing a stacking device 10 in which a device according to the present invention has been mounted. A stacking device 10 of this kind may, for example, be mounted behind a printer. By coupling a printer's sheet outlet to the entry point of a stacking device 10 of this kind, sheets from the printer may be stacked neatly when the registration actions are performed by stacking device 10. A stacking device 10 of this kind may be embodied with various output facilities, such as, but not limited to, a pallet output facility for feeding stacks easily from the stacking device onto a pallet, a binding facility for binding the stacks together, for example using a plastic strip or another method, in order to maintain the stack shape also during transport.

Stacking unit 10 as shown in FIG. 1 receives sheets via sheet inlet 11. A sheet that has been fed in is then conveyed against a registration wall 13 by means of a registration ruler 12. In the embodiment shown, the transport clamping arrangements of registration ruler 12 have been formed in such a way that a force is transferred from the clamping arrangement onto the sheet in the direction of registration wall 13. As soon as the sheet lies against the registration wall, the force of the clamping arrangement on the sheet will predominantly be applied in the direction of transportation and to a lesser extent in the direction of registration wall 13, as sheet deformation may occur if excessive force is applied when a sheet is conveyed against a registration wall. This may be achieved by embodying the transport clamping arrangement of the registration ruler with wheels that are more flexible in the one lateral direction than in the other lateral direction. The moment a sheet lies against the registration wall, the transport wheel will bend outwards and transfer a force that is predominantly directed in the transport direction, causing a sheet that has reached the registration wall to be pushed against the wall without excessive force, thus preventing sheet deformations.

Figure 2:
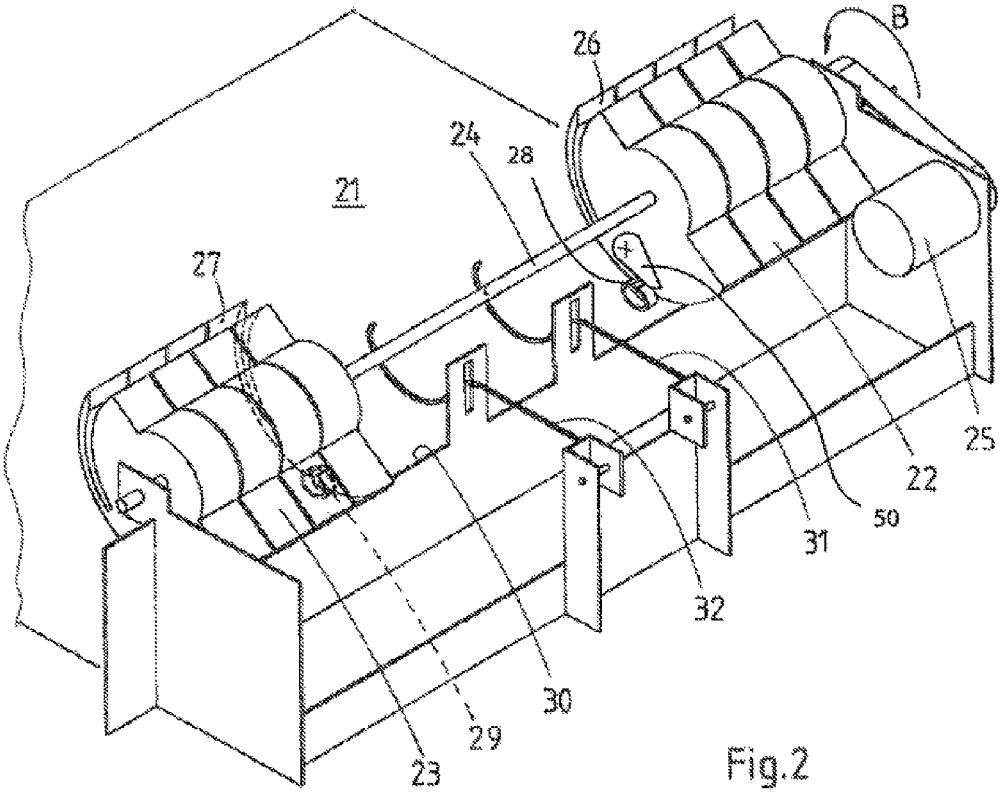
FIG. 2 is a schematic perspective view showing a part of a flipping device according to the present invention.

Because of this first registration action, all sheets enter reversing loop 14 at the same height. Behind this reversing loop 14, an input clamping arrangement 15 is positioned, which forms the inlet transport into the module, inside which a flipping device 20 according to the present invention is mounted. This module feeds incoming sheets into a straight stack onto a receiving plane 21. This receiving plane 21 may be height adjustable, so that the stacking capacity of the stacking unit may be increased. The stack may be removed from the unit via an opening hatch or another type of outlet opening 16. Stacking unit 10 may also comprise means (not shown) to assist a user in removing the stack out of the unit, for example by conveying the stack out of the stacking unit, in whole or in part. This may, for example, be embodied as a power-steered drawer, which, after opening outlet opening 16, is conveyed out of the unit. A stacking device of this kind may be either electronically connected to a printer so that the timing of sheets may be communicated, or embodied fully autonomously, where the timing of incoming sheets is detected by the stacking unit itself FIG. 2 is a diagram showing a device according to the present invention. The device according to the present invention comprises a receiving plane 21 and two rotatably arranged elements 22 and 23, which are connected to an electrically driven motor 25 and a rotation shaft 24. The device may comprise one or more rotatably arranged elements of this kind. Electrically driven motor 25 may, for example, be an electric servo motor or stepping motor. The rotatably arranged elements comprise slots 26 and 27 in which an incoming sheet may be accepted in whole or in part from input clamping arrangement 15. In the position shown in FIG. 2, rotatable elements 22 and 23 are located in the first rotation zone, in which the leading edge of a sheet may be accepted into slots 26 and 27.

Cam following pivot elements 50 are mounted pivotably on each of the rotatably arranged elements 22 and 23. Closed-loop shaped friction elements 28 and 29 are mounted on the cam following pivot elements 50. The cam following pivot elements 50 are biased inwards by means of a spring force, while a cam engages with these cam following pivot elements, just before the sheet is urged against stop 30. By pivoting outward in a radial direction of the rotatably arranged elements 22 and 23, the friction elements do not interfere with an incoming sheet during acceptance of that sheet in the slot 26, 27, while an urging force is applied during the urging of the sheet against the stop 30. Note that, for reasons of clarity of illustration, the rotatably arranged elements 22 and 23 have been illustrated partially. In practice, the rotatably arranged elements 22 and 23 are formed as a full cylinder comprising two slots and two pivotable elements. By actuating motor 25, rotation shaft 24 is driven in the direction of arrow B, where rotatably arranged elements 22 and 23, and as a result, also slots 26 and 27, as well as the sheet accepted within, are conveyed in the direction of stop 30 according to arrow B. During the movement of rotation shaft 24, closed-loop shaped friction elements 28 and 29 connected to the rotation shaft will exercise a force with a component in the direction of the stop on the upper side of the sheet that was last deposited onto receiving plane 21, so that the sheet is conveyed against stop 30. In the description below, the movement cycle of the device will be described in more detail. It will be understood by those skilled in the art that, when receiving plane 21 does not contain any sheets, the closed-loop shaped friction elements 28 and 29 will brush over receiving plane 21.

The embodiment shown in FIG. 2 furthermore comprises a tool to restrict the freedom of movement of the edge of any sheets that have already been deposited onto receiving plane 21. This will reduce any curling or other form of deformation of the sheet edge, which will have a beneficial effect on the registration behavior of sheets conveyed onto receiving plane 21. In this example of an embodiment, retention hooks 31 and 32 have been mounted, which have been rotatably attached to the frame end and are bent at the other side, in such a way that any incoming sheets conveyed from slots 26 and 27 at the level of stop 30 onto the receiving plane may easily be conveyed under here, whilst the freedom of movement of the sheet edge is restricted. The retention force of the hooks onto the sheet edge is predominantly directed downwards and may, for example, be delivered exclusively by the hooks' own weight in a gravity field and/or by means of a torsion spring at the position of attachment to the frame or by means of magnetic pull.

Figure 3C:
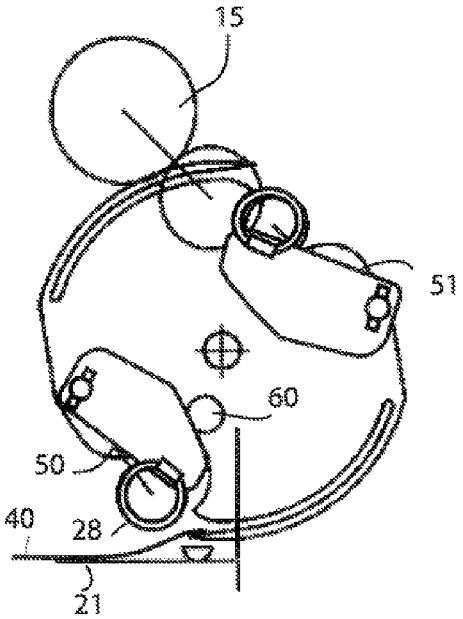
FIGS. 3A-D are schematic diagrams showing a flipping device according to the present invention during the reception and expelling of a sheet.
Figure 3D:
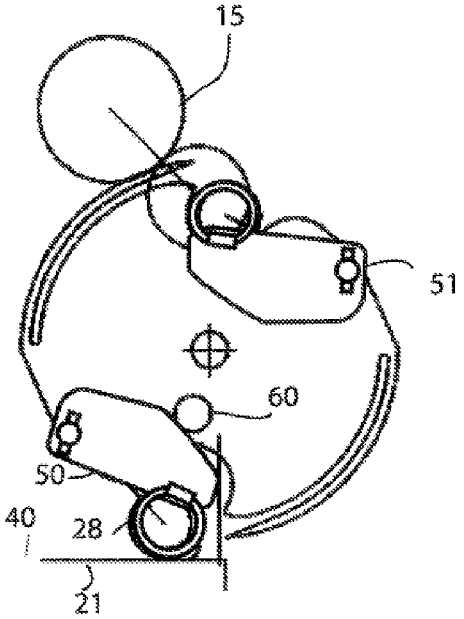
Figure 3A:
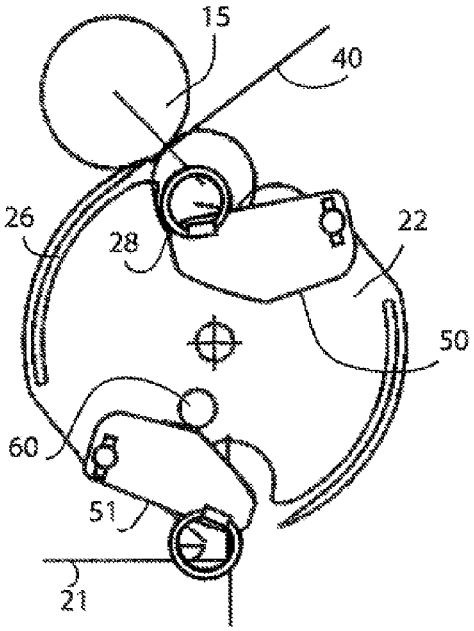
Figure 3B:
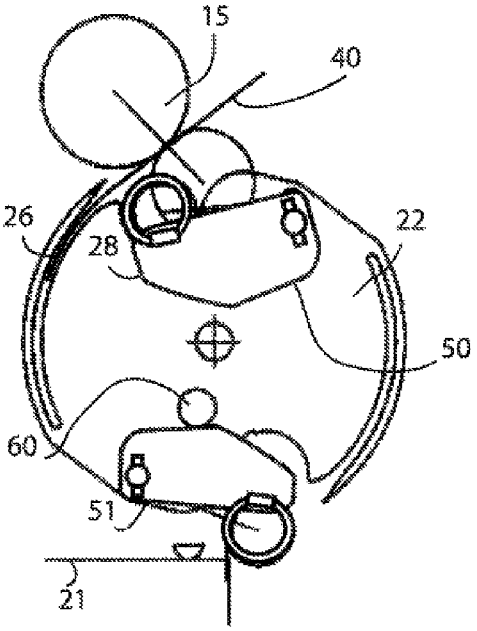

FIGS. 3A-D are schematic diagrams showing a flipping device according to the present invention during the reception and expelling of a sheet. FIG. 3A illustrates the device is in its receiving position, in the first rotation zone. Slot 26 is positioned relative to input clamping arrangement 15 in such a way that a sheet 40 may be accepted into slot 26. This first rotation zone may be very small, if the rotatably arranged element is halted whilst a sheet 40 is accepted into slot 26. Cam following pivot element 50, on which the friction element 28 has been mounted, is in its retracted inward orientation, such that the incoming sheet is not disturbed. If the rotatably arranged element is not halted, the relative speed of accepting sheet 40 relative to the rotation speed of the rotatably arranged element will need to be high enough to at least partially accept sheet 40. Subsequently, sheet 40 is conveyed through input clamping arrangement 15 in slot 26. This is illustrated in FIG. 3B. If a sheet 40 is next accepted into slot 26, the rotatably arranged element may be conveyed further so that the leading edge of sheet 40 will be conveyed against stop 30 during this revolution. As rotatably arranged element 22 continues to rotate from this position, whilst the movement of sheet 40 is halted by stop 30, sheet 40 will be conveyed onto receiving plane 21 as illustrated in FIG. 3C. Here, sheet 40 has been entirely deposited onto receiving plane 21. Rotatably arranged element 22 may continue to rotate to the first rotation zone in which a new sheet may be accepted into slot 26, and the cycle can start all over again. A sheet 40 that is deposited onto receiving plane 21, does not yet have the right registration relative to stop 30 in this case. A sheet 40 may, for example, be left at some distance from stop 30. Cam 60 is positioned such that cam following pivot element 50 is forced radially outward such that the friction element 28 is engaged with the top of the deposited sheet. As a closed-loop shaped friction element 28 is now forced beyond the radial circumferential edge of rotatable element 22, a force with component F in the direction of stop 30 may be exercised on the upper side of a sheet 40, which has been deposited onto receiving plane 21, so that the sheet may still adopt the right registration relative to stop 30. This is shown in FIG. 3D. Closed-loop shaped friction element 28 must not obstruct the movement of sheet 40 from input clamping arrangement 15. Therefore, the cam following pivot element 50 is urged radially inward by a spring (not shown), such that after passing the cam 60 the pivot element is urged inside the circumferential edge of the rotatably arranged element.

Figure 4:
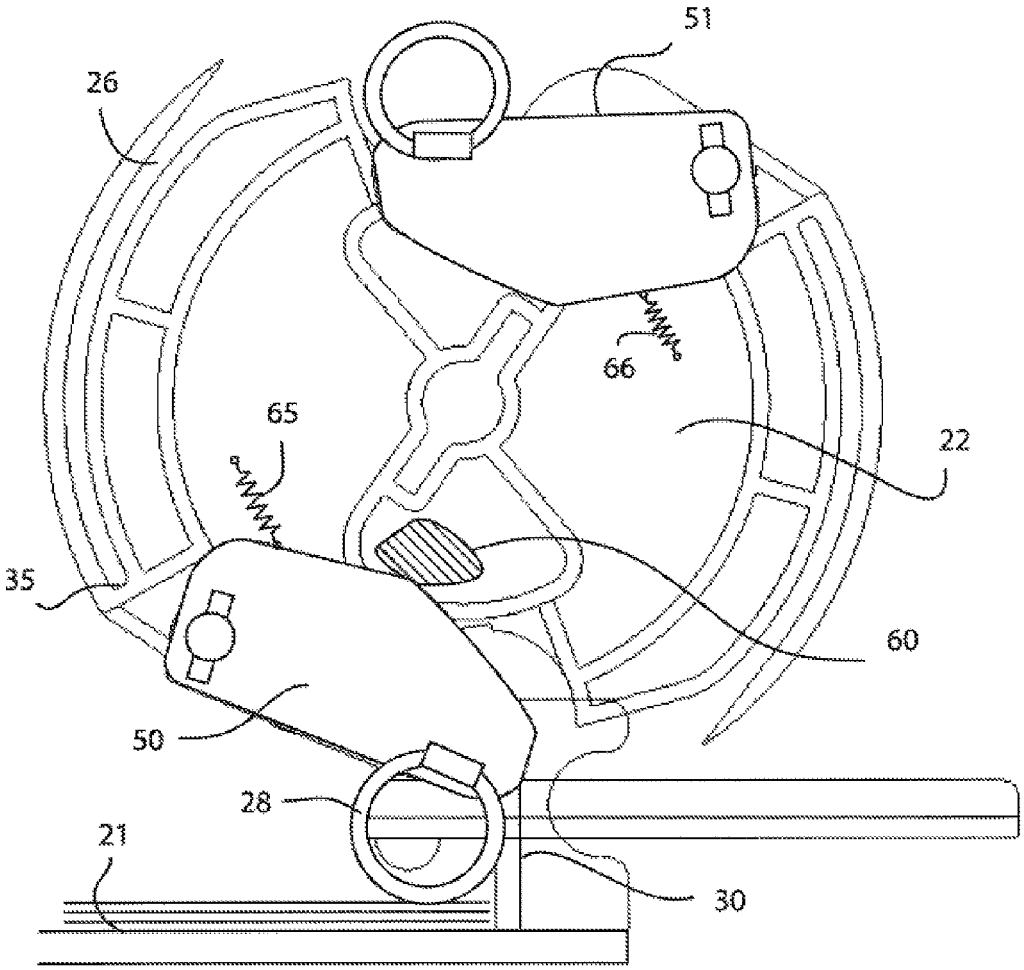
FIG. 4 is a schematic side view showing a flipping element of a flipping device according to the present invention.

FIG. 4 is a schematic side view showing a flipping element of a flipping device according to the present invention. FIG. 4 shows in some detail the rotatably arranged element 22 comprising slot 26 for enclosing a portion of a sheet to be stacked on receiving plane 21 on which a stack of subsequently fed sheets is formed on a stack, registered against stop 30. Cam following pivot element 50, 51 comprising friction element 28 is forced radially outward by cam 60 and urged radially inward by spring 65, 66.

Detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims and/or embodiments may be applied in combination and any combination of such claims and/or embodiments are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet stacking device for forming a stack of subsequent sheets, wherein in operation a sheet follows a transport path from a sheet supply to a receiving plane on which the stack of subsequent sheets is formed, the sheet stacking device comprising:

a rotatably arranged flipping element, comprising a slot at its circumferential edge for accepting at least a portion of a sheet to be stacked, configured such that, in a first rotation zone, the rotatably arranged flipping element is able to accept the sheet from the sheet supply into the slot and, in a second rotation zone, the sheet is conveyed out of the slot onto the top of the stack of subsequent sheets on the receiving plane; and a closed-loop shaped friction element moveably arranged on the rotatably arranged flipping element, such that:

the closed-loop shaped friction element is controllable to move into a first radial position if the closed-loop shaped friction element is in the first rotation zone, such that in the first radial position the closed-loop shaped friction element does not apply a frictional force to a sheet in the transport path; and the closed-loop shaped friction element is controlled to move into a second radial position if the closed-loop shaped friction element is in the second rotation zone, such that in the second radial position the closed-loop shaped friction element does apply a frictional force to a sheet in the transport path, wherein in the first radial position the closed-loop shaped friction element is positioned fully within the radial circumferential edge of the rotatably arranged flipping element, such that an incoming sheet is not disturbed by the closed-loop shaped friction element, and in the second radial position the closed-loop shaped friction element extends beyond the radial circumferential edge of the rotatably arranged flipping element.

2. The sheet stacking device according to claim 1, wherein the control of the movement of the closed-loop shaped friction element comprises a cam and cam follower construction.

3. The sheet stacking device according to claim 2, further comprising a cam element rotatably arranged on the rotatably arranged flipping element, wherein the closed-loop shaped friction element is mounted on the cam element.

4. The sheet stacking device according to claim 3, wherein the cam element is urged into the first radial position by means of a spring.

5. The sheet stacking device according to claim 3, wherein the cam element is urged into the second radial position by means of a cam and cam follower mechanism.

6. The sheet stacking device according to claim 1, further comprising an electric motion actuator for actuating the closed-loop shaped friction element, and wherein the movement of the closed-loop shaped element is electronically controlled.

7. A printing system comprising a sheet supply unit, a printing engine for applying a marking substance to a sheet and a sheet stacking device according to claim 1.

8. The sheet stacking device according to claim 1, wherein in the first radial position the closed-loop shaped friction element is positioned within the outer radial circumferential edge of the rotatably arranged flipping element, such that an incoming sheet is not disturbed by the closed-loop shaped friction element, and in the second radial position the closed-loop shaped friction element extends beyond the outer radial circumferential edge of the rotatably arranged flipping element.

9. A sheet stacking device for forming a stack of subsequent sheets, wherein in operation a sheet follows a transport path from a sheet supply to a receiving plane on which the stack of subsequent sheets is formed, the sheet stacking device comprising:

a rotatably arranged flipping element, comprising a slot at its circumferential edge for accepting at least a portion of a sheet to be stacked, configured such that, in a first rotation zone, the rotatably arranged flipping element is able to accept the sheet from the sheet supply into the slot and, in a second rotation zone, the sheet is conveyed out of the slot onto the top of the stack of subsequent sheets on the receiving plane;

a closed-loop shaped friction element moveably arranged on the rotatably arranged flipping element, such that the closed-loop shaped friction element is controllable to move into one of a first radial position and a second radial position, such that in the first radial position, the closed-loop shaped friction element does not apply a frictional force to a sheet in the transport path and such that in the second radial position, the closed-loop shaped friction element does apply a frictional force to a sheet in the transport path; and a cam element rotatably arranged on the rotatably arranged flipping element, the closed-loop shaped friction element being mounted on the cam element, wherein the control of the movement of the closed-loop shaped friction element comprises a cam and cam follower construction.

10. The sheet stacking device according to claim 9, wherein the closed-loop shaped friction element is controlled to move into the first radial position if the closed-loop shaped friction element is in the first rotation zone.

11. The sheet stacking device according to claim 9, wherein the closed-loop shaped friction element is controlled to move into the second radial position if the closed-loop shaped friction element is in the second rotation zone.

12. The sheet stacking device according to claim 9, wherein the cam element is urged into the first radial position by means of a spring.

13. The sheet stacking device according to claim 9, wherein the cam element is urged into the second radial position by means of the cam and cam follower mechanism.

14. The sheet stacking device according to claim 9, further comprising an electric motion actuator for actuating the closed-loop shaped friction element, and wherein the movement of the closed-loop shaped element is electronically controlled.

15. A printing system comprising a sheet supply unit, a printing engine for applying a marking substance to a sheet and a sheet stacking device according to claim 9.

* * * * *